US005297940A

United States Patent [19]

Buse

[11] Patent Number: 5,297,940

[45] Date of Patent: Mar. 29, 1994

[54] SEALLESS PUMP CORROSION DETECTOR

[75] Inventor: Frederic W. Buse, Allentown, Pa.

[73] Assignee: Ingersoll-Dresser Pump Company, Liberty Corner, N.J.

[21] Appl. No.: 997,441

[22] Filed: Dec. 28, 1992

[51] Int. Cl.[5] ..... F04B 21/00

[52] U.S. Cl. ..... 417/63; 417/420; 417/423.11; 73/86

[58] Field of Search ..... 417/63, 420, 423.1; 415/118, 19; 116/208; 73/86

[56] References Cited

U.S. PATENT DOCUMENTS

| | | | |
|---|---|---|---|
| 1,426,956 | 8/1922 | Case . | |
| 2,484,279 | 10/1949 | Folz | 73/86 |
| 2,636,090 | 4/1953 | Branshofsky . | |
| 3,621,810 | 11/1971 | Zuck | 73/86 |
| 3,630,216 | 12/1971 | Kelly | 73/86 |
| 3,846,795 | 11/1974 | Jones | 73/86 |
| 3,922,999 | 12/1975 | Meginnis . | |
| 4,535,326 | 8/1985 | Mullins et al. | 415/118 |
| 4,617,822 | 10/1986 | Davis . | |
| 4,854,823 | 8/1989 | Hatting et al. | 417/63 |
| 4,871,301 | 10/1989 | Buse | 417/420 |

FOREIGN PATENT DOCUMENTS

| | | | |
|---|---|---|---|
| 3805322 | 8/1989 | Fed. Rep. of Germany | 417/420 |
| 45731 | 3/1985 | Japan | 415/118 |
| 246637 | 10/1988 | Japan | 73/86 |
| 1-34006 | 5/1989 | Japan | 415/118 |
| 665108 | 5/1979 | U.S.S.R. | 73/86 |

*Primary Examiner*—Richard A. Bertsch
*Assistant Examiner*—Roland G. McAndrews
*Attorney, Agent, or Firm*—Michael H. Minns

[57] ABSTRACT

A corrosion detector for use with a sealless centrifugal pump. The corrosion detector having a corrosion coupon at one end of the detector. The corrosion coupon being formed of the same material as the pump containment shell and having a thickness approximately two thirds the thickness of the containment shell. The corrosion detector is preferably installed in a bore in the pump discharge flange such that the corrosion coupon is exposed to the velocity of the pumped fluid. A detector is mounted within the corrosion detector to detect any leakage of the pumped fluid through the corrosion coupon. The corrosion coupon is designed so that this leakage will occur before the containment shell has failed or begun leaking due to corrosion.

14 Claims, 1 Drawing Sheet

SEALLESS PUMP CORROSION DETECTOR

BACKGROUND OF THE INVENTION

This invention relates generally to sealless pumps and more particularly to a means of detecting corrosion of the sealless pump containment shell.

A sealless pump is a type of centrifugal pump that has its impeller and bearing system isolated from the impeller driving mechanism by an isolating wall or shell that seals the pumping mechanism from the surrounding environment and eliminates the necessity to use rotary seals to seal the pumped fluid against leaking along the shaft. This type of pump is particularly desirable when pumping environmentally sensitive fluids such as hydrocarbons. In one type of sealless pump, the driving mechanism is coupled to the pump impeller by an arrangement of magnets located on the opposite sides of the isolating wall which magnetically connects the torque of the driving mechanism to the impeller. In another type of sealless pump, a canned pump, an electric motor is enclosed within the isolating wall or shell.

The containment shell of a sealless pump has a relatively thin wall, 0.015 to 0.060 inches, depending upon the design. This is typical of both canned and magnetically coupled sealless pumps. Due to the construction of either type of design, it is difficult to determine the rate of corrosion that may be occurring in this shell. Most detection systems currently used, detect leakage through the shell after corrosion has penetrated the shell. Because of the fluids typically pumped with sealless pumps, it is important to have advance warning of shell failure or leakage due to corrosion.

The foregoing illustrates limitations known to exist in present sealless pumps. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a sealless centrifugal pump comprising a pump housing containing a pumping chamber and having an inlet, an outlet, and a bore, a shaft mounted in the pump housing for rotation, a pump impeller attached to the shaft for rotation with the shaft in the pumping chamber, a shell enclosing the shaft and impeller to seal the pump from the exterior and prevent the pumped fluid from leaking, and a means for detecting corrosion, the means for detecting corrosion comprising a corrosion probe mounted in the pump housing bore, an end portion of the corrosion probe being formed of material having known corrosion properties, and a means for indicating leakage within the corrosion probe, the means for indicating leakage being responsive to any leakage through the end portion of the corrosion probe.

The foregoing and other aspects will become apparent from the following detailed description of the invention when considered in conjunction with the accompanying drawing figures.

BRIEF DESCRIPTION OF THE DRAWING FIGURES

FIG. 1 is a cross-section of a magnetically coupled centrifugal pump.

DETAILED DESCRIPTION

Figure 1:
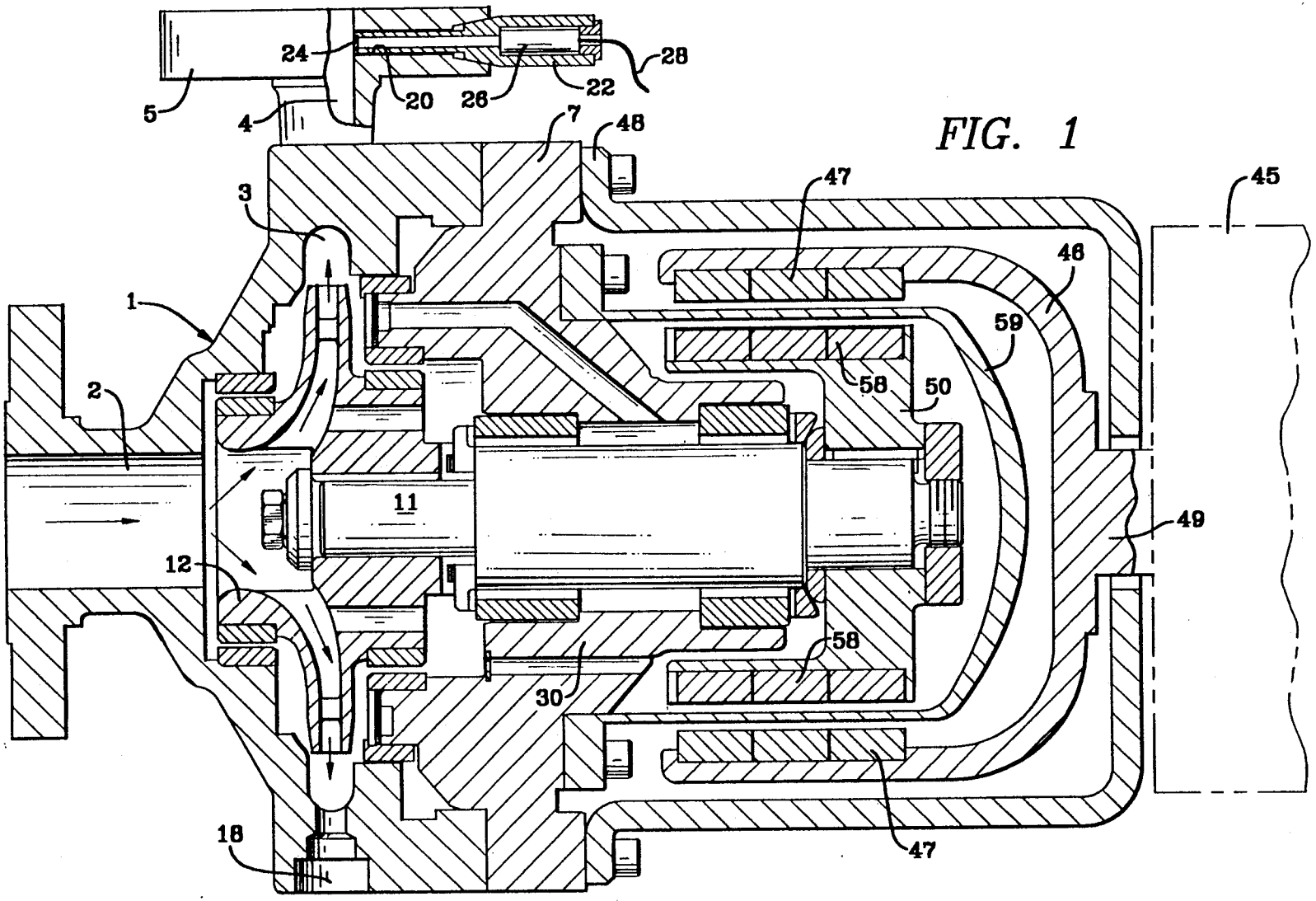

This invention is a hollow probe that fits into the drilled and tapped boss for pressure gauges in the casing suction or discharge flanges of a pump. Most applications will use the discharge flange to simulate the liquid velocity of the rotor or inner casing. The probe can also be fitted into other drilled or tapped holes such as in the casing cover. The material of the body of the probe can be the same material as the casing. The thickness of the body of the probe is much greater than the end of the probe. The end of the probe is preferably the same material as the containment shell. The thickness is typically two thirds the thickness of the containment shell. Generally, the amount of corrosion at the end of the probe will be greater than at the containment shell of the body of the probe. When the end of the probe corrodes through, liquid under pressure will go through the hollow body of the probe and trigger a sensor indicating that the end of the probe has been breached. The sensor can be pressure, temperature, optical or electrical conductivity, all of them indicating the presence of liquid in the body of the probe. This sensor will alert the operator that the containment shell is also probably being corroded to the same extent, and that the pump should be shut down for inspection or replacement of the shell before it too is breached and leaks. The invention can be used on any pump or liquid transportation device with a flange or a tap, where the moving pumped liquid can come in contact with the end of the probe.

The magnetically coupled centrifugal pump shown in FIG. 1 includes a pump casing 1 containing an axial inlet 2, a pumping chamber 3 and an outlet 4, all of which are interconnected by passages extending through the casing 1. The pump casing 1 has an annular flange surrounding the pumping chamber 3. A casing cover 7 is bolted to the annular flange on the pump casing 1. The pump casing 1 and casing cover 7 form the pump housing. An extended portion 30 of the casing cover 7 rotatably supports an axially extending shaft 11. An impeller 12 is attached to one end of the shaft 11. The shaft 11 is rotatably supported by front and rear journal bearing bushings.

A magnet holder 50 is attached to the rear end of shaft 11. The magnet holder 50 has a hollow cylindrical shape with the end opposite the rear end of shaft 11 being open. The exterior surface of the magnet holder 50 carries a series of magnets 58 which rotate closely about the interior of a relatively thin can-shaped shell 59 which fits over the magnet holder 50 and the extended portion 30 of the casing cover 7. The shell 59 forms part of the pump housing and is part of the pump pressure boundary.

A power frame 48 fits over the shell 59 of the casing cover 7 and is attached to the pump casing 1 and casing cover 7 by a series of bolts. A drive shaft 49 is rotatably mounted in the power frame 48. The outer end of drive shaft 49 is connected to a driving device 45 using conventional coupling means. The driving device 45 is preferably an electric motor.

An outer magnet holder 46 is attached to the drive shaft 49. The outer magnet holder 46 has a hollow cylindrical shape open at one end. The outer magnet holder 46 carries a series of magnets 47 spaced around its interior surface which are magnetically coupled to the magnets 58 on the inner magnet holder 50 for transmitting torque from the driving device 45 to the pump impeller shaft 11.

As shown in FIG. 1, the present invention is a corrosion probe 22, which is mounted in a bore 20. Bore 20 is located in flange 5 which forms part of the pump discharge or outlet 4. Flange 5 is used to bolt the pump to process piping. Preferably, corrosion probe 22 is mounted in a bore which is already present in the pump casing 1. As shown in FIG. 1, bore 20 is a drilled and tapped hole used for measuring the discharge pressure of the pump. Corrosion probe 22 could also be attached to the pump drain passage 18 or a bore specifically for the corrosion probe 22 could be drilled and tapped in the pump casing 1.

The corrosion probe 22 consists of a corrosion coupon 24 attached to one end of the corrosion probe 22, a leakage sensor 26 within the body of the corrosion probe 22 and a signal wire 28 connecting the leakage sensor 26 to appropriate alarm or indicating systems. The end of the corrosion probe 22 containing the corrosion coupon 24 is exposed to the liquid within the pump casing 1. Preferably, the corrosion probe 22 is placed at or near the discharge of the impeller 12 or the pump discharge 4. This simulates the liquid velocity of the rotor or inner casing.

The preferred embodiment uses a corrosion coupon 24 formed of the same material as the containment shell 59. For most applications, the thickness of the corrosion coupon 24 is two thirds of the thickness of the thinnest portion of the shell 59. With a thickness of the corrosion coupon 24 two thirds of the thickness of the shell 59, the corrosion coupon 24 will corrode through and be breached before the shell 59 is in danger of leaking due to corrosion. In the event conditions at the location of the corrosion coupon 24 are more severe than the conditions at the shell 59, the corrosion coupon 24 may be thicker than the shell 59.

Although the preferred embodiment uses a corrosion coupon 24 of the same material as the shell 59, this is not required for the present invention. The corrosion properties of the corrosion coupon 24 must be known properties. For example, if a corrosion coupon 24 is formed of a material that corrodes at a rate substantially the same as the shell 59, then the preferred thickness of the corrosion coupon 24 would be two thirds of the thickness of the shell 59. If the corrosion coupon 24 were to corrode at twice the rate of the shell 59, then the thickness of the corrosion coupon 24 would be one and one third the thickness of the shell 59. As long as the rates of corrosion of the corrosion coupon 24 and the shell 59 are known, an appropriate thickness for the corrosion coupon 24 can be determined. Generally, the thickness of the corrosion coupon 24 will be two thirds of the thickness of the shell 59 multiplied by the ratio of the corrosion rate of the coupon 24 to the corrosion rate of the shell 59. If a different margin between the breach of the corrosion coupon 24 and the shell 59 is desired, a factor other than two thirds can be used.

The leakage sensor 26 can be any type of sensor which will detect the presence of liquid within the corrosion probe 22. This can include pressure, temperature or optical sensors. In the event the pumped fluid is conductive, the leakage sensor 26 can be a resistance or conductivity sensor.

The preferred embodiment of the corrosion is for use with a magnetically coupled sealless pump. The corrosion detector can also be used with a canned sealless pump.

Having described the invention, what is claimed is:

1. A sealless centrifugal pump comprising:

a pump housing containing a pumping chamber and having an inlet, an outlet and a bore;

a shaft mounted in the pump housing for rotation;

a pump impeller attached to the shaft for rotation with the shaft in the pumping chamber;

a shell enclosing the shaft and pump impeller; and a means for detecting corrosion, the means for detecting corrosion comprising a corrosion probe mounted in the pump housing bore, an end portion of the corrosion probe being formed of material having known corrosion properties, the end portion of the corrosion probe being in fluid contact with the pumped fluid, the thickness of the end portion of the corrosion probe being two thirds the thickness of the shell, and a means for indicating leakage within the corrosion probe, the means for indicating leakage being responsive to any leakage through the end portion of the corrosion probe.

2. The sealless centrifugal pump according to claim 1, further comprising:

an electric motor for rotating the shaft, the electric motor being located within the pump housing and shell.

3. The sealless centrifugal pump according to claim 1, further comprising:

a first magnetic means attached to an end of the shaft. The first magnetic means adapted to be magnetically coupled to a second magnetic means rotated by a rotary driving device, the shaft being mounted in at least two bearings spaced from each other along the length of the shaft and located between the impeller and the first magnetic means;

the shell surrounding the shaft bearings and first magnetic means and being located between the two magnetic means.

4. The sealless centrifugal pump according to claim 1, wherein the end portion of the corrosion probe is formed of the same material as the shell.

5. The sealless centrifugal pump according to claim 1, wherein the end portion of the corrosion probe is formed of material having corrosion properties substantially the same as the corrosion properties of the shell.

6. The sealless pump according to claim 1, wherein the pump housing bore is proximate the outlet of the pump.

7. The sealless pump according to claim 1, wherein the pump housing bore comprises a pump housing drain.

8. The sealless pump according to claim 1, wherein the end portion of the corrosion probe is in contact with moving pumped fluid.

9. A corrosion detector for use with a sealless centrifugal pump, the sealless centrifugal pump having a pump housing and a containment shell, the corrosion detector comprising:

a body having an internal bore;

a corrosion coupon closing an end of the internal bore, the corrosion coupon being in contact with the pumped fluid, the thickness of the corrosion coupon being two thirds the thickness of the shell multiplied by the ratio of the corrosion rate of the end of the corrosion probe to the corrosion rate of the containment shell;

a means for indicating leakage within the body, the means for indicating leakage being responsive to leakage of pumped fluid through the corrosion coupon.

10. The sealless centrifugal pump according to claim 9, wherein the corrosion coupon is formed of the same material as the containment shell.

11. The sealless centrifugal pump according to claim 9, wherein the corrosion coupon is formed of material having corrosion properties substantially the same as the corrosion properties of the containment shell.

12. The sealless centrifugal pump according to claim 9, wherein the thickness of the corrosion coupon is two thirds the thickness of the containment shell.

13. A sealless centrifugal pump comprising:

a pump housing containing a pumping chamber and having an inlet, an outlet and a bore;

a shaft mounted in the pump housing for rotation;

a pump impeller attached to the shaft for rotation with the shaft in the pumping chamber;

a shell enclosing the shaft and pump impeller; and a means for detecting corrosion, the means for detecting corrosion comprising a corrosion probe mounted in the pump housing bore, an end portion of the corrosion probe being formed of material having known corrosion properties, the end portion of the corrosion probe being in fluid contact with the pumped fluid, the thickness of the end portion of the corrosion probe being two thirds the thickness of the shell multiplied by the ratio of the corrosion rate of the end portion of the corrosion probe to the corrosion of the shell, and a means for indicating leakage within the corrosion probe, the means for indicating leakage being responsive to any leakage through the end portion of the corrosion probe.

14. A magnetically coupled centrifugal pump comprising:

a pump housing containing a pumping chamber and having an inlet, an outlet and a bore, the bore being located proximate the outlet;

a shaft mounted in the pump housing for rotation;

a pump impeller attached to the forward end of the shaft for rotation with the shaft in the pumping chamber and a first magnetic means attached to the rear end of the shaft, the first magnetic means adapted to be magnetically coupled to a second magnetic means rotated by a rotary driving device, the shaft being mounted in at least two bearings spaced from each other along the length of the shaft and located between the impeller and the first magnetic means;

a shell surrounding the shaft bearings and first magnetic means, the shell being located between the two magnetic means; and a means for detecting corrosion, the means for detecting corrosion comprising a corrosion probe mounted in the pump housing bore, an end portion of the corrosion probe being formed of the same material as the shell and having a thickness two thirds the thickness of the shell, the end portion of the corrosion probe being in fluid contact with the pumped fluid, and a means for indicating leakage within the corrosion probe, the means for indicating leakage being responsive to any leakage through the end portion of the corrosion probe.

* * * * *

UNITED STATES PATENT AND TRADEMARK OFFICE

CERTIFICATE OF CORRECTION

PATENT NO. : 5,297,940

DATED : 03/29/94

INVENTOR(S) : Frederic W. Buse

It is certified that error appears in the above-indentified patent and that said Letters Patent is hereby corrected as shown below:

Column 4:
Claim 3, lines 29-30, delete ". The" and replace with --, the--

Column 5:
Claim 10, line 3, delete "sealless centrifugal pump" and replace with --corrosion detector--

Column 5:
Claim 11, line 6, delete "sealless centrifugal pump" and replace with --corrosion detector--

UNITED STATES PATENT AND TRADEMARK OFFICE

CERTIFICATE OF CORRECTION

PATENT NO. : 5,297,940

DATED : 03/29/94

INVENTOR(S) : Frederic W. Buse

It is certified that error appears in the above-indentified patent and that said Letters Patent is hereby corrected as shown below:

Column 5:

Claim 12, line 11, delete "sealless centrifugal pump" and replace with —corrosion detector—.

Signed and Sealed this

Twentieth Day of September, 1994

Bruce Lehman

*Attest:*

BRUCE LEHMAN

*Attesting Officer*

*Commissioner of Patents and Trademarks*